US009623679B1

(12) United States Patent
Leighton et al.

(10) Patent No.: US 9,623,679 B1
(45) Date of Patent: Apr. 18, 2017

(54) ELECTROSTATIC PLATEN FOR CONDUCTIVE PET FILM PRINTING

(71) Applicant: XEROX CORPORATION, Norwalk, CT (US)

(72) Inventors: Roger G. Leighton, Hilton, NY (US); Paul M. Fromm, Rochester, NY (US); Alexander Wende, Webster, NY (US); Gerald Fletcher, Pittsford, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/944,940

(22) Filed: Nov. 18, 2015

(51) Int. Cl.
*B41J 11/02* (2006.01)

(52) U.S. Cl.
CPC ..... *B41J 11/02* (2013.01)

(58) Field of Classification Search
CPC .. H01L 21/6831; H01L 21/6833; B41J 11/02; B41J 11/08; B41J 11/06; B41J 11/10
See application file for complete search history.

(56) References Cited

U.S. PATENT DOCUMENTS 3,916,270 A * 10/1975 Wachtler ..... B43L 5/02 361/234
4,184,188 A * 1/1980 Briglia ..... G03F 7/20 118/500
4,751,609 A * 6/1988 Kasahara ..... B23Q 3/154 361/234
5,179,498 A * 1/1993 Hongoh ..... H01L 21/6831 269/8
5,486,974 A * 1/1996 Kasahara ..... H02N 13/00 361/234
5,538,758 A * 7/1996 Beach ..... B05D 1/60 427/255.6
5,764,471 A * 6/1998 Burkhart ..... H01L 21/6833 361/234
6,019,466 A 2/2000 Hermanson
7,216,968 B2 5/2007 Smith et al.
8,061,835 B2 11/2011 Nakashima
2005/0190250 A1* 9/2005 Howarth ..... B41J 11/007 347/104
2008/0083736 A1* 4/2008 Steger ..... H01L 21/67248 219/494
2009/0057573 A1* 3/2009 Low ..... H01J 37/08 250/492.21
2011/0229837 A1* 9/2011 Migita ..... C23C 14/50 432/227
2013/0155569 A1* 6/2013 Suuronen ..... B23Q 3/152 361/234
2013/0228548 A1* 9/2013 Ptasienski ..... H05B 3/20 216/20
2014/0007416 A1* 1/2014 Lindley ..... H01L 21/67103 29/611

(Continued)

*Primary Examiner* — David Banh
(74) *Attorney, Agent, or Firm* — MH2 Technology Law Group LLP

(57) ABSTRACT

Methods and devices for creating an electrostatic force. An electrostatic platen device includes a continuous conductive layer; a first dielectric layer provided on a first surface of the continuous conductive layer; and a second dielectric layer provided on a second surface of the continuous conductive layer opposite to the first surface of the conductive layer. A power source is electrically coupled to the continuous conductive layer to generate an electric tacking field.

20 Claims, 3 Drawing Sheets

(56) References Cited

U.S. PATENT DOCUMENTS

| | | | | |
|---|---|---|---|---|
| 2014/0008880 | A1* | 1/2014 | Miura | H01L 21/6833 279/128 |
| 2016/0020128 | A1* | 1/2016 | Wang | H01L 21/6833 361/234 |

* cited by examiner

ELECTROSTATIC PLATEN FOR CONDUCTIVE PET FILM PRINTING

TECHNICAL FIELD

The present disclosure relates generally to methods, apparatus, and systems, for providing an electrostatic platen for conductive material printing.

BACKGROUND

In existing solid ink printing devices, material on which an image is to be formed is held down onto a platen assembly using a vacuum. The platen assembly includes a platen that has thousands of holes machined therein. One or more fans are used to draw air through the holes thereby creating a vacuum. When a printing material is placed on the platen, the printing material is held to the platen via the force created by the vacuum.

However, the one or more fans used in creating the vacuum are noisy and produce mechanical vibration. Further, the image formed on the printing material may include artifacts from the holes machined in the platen due to thermal non-uniformity. Still further, the solid ink that remains on the platen due to head leakage or machine timing error is difficult to clean due to the numerous holes in the platen. Ink that has not been cleaned from the holes of the platen may diminish the effect of the vacuum thereby rendering the positioning of the printing material on the platen unstable, which may affect future printing.

SUMMARY OF THE INVENTION

The present disclosure relates generally to methods and devices for holding a printing material on a platen.

In some embodiments, an electrostatic platen device includes a continuous conductive layer; a first dielectric layer provided on a first surface of the continuous conductive layer; a second dielectric layer provided on a second surface of the continuous conductive layer opposite to the first surface of the conductive layer; and a power source electrically coupled to the continuous conductive layer to generate an electric field.

In further embodiments, an electrostatic platen device includes a continuous conductive layer; a first dielectric layer provided on a first surface of the continuous conductive layer; a second dielectric layer provided on a second surface of the continuous conductive layer opposite to the first surface of the conductive layer; a thermal spreader layer provided on a first surface of the second dielectric layer that is opposite to a second surface of the second dielectric layer on which the continuous conductor layer is provided; a third dielectric layer provided on a first surface of the thermal spreader layer that is opposite to a second surface of the thermal spreader layer on which the second dielectric layer is provided; a thermal layer provided on a first surface of the third dielectric layer that is opposite to a second surface of the third dielectric layer on which the thermal spreader layer is provided; and a fourth dielectric layer provided on a first surface of the thermal layer that is opposite to a second surface of the thermal layer on which the third dielectric layer is provided.

BRIEF DESCRIPTION OF THE DRAWINGS

The accompanying drawings, which are incorporated in and constitute a part of this specification, illustrate various embodiments of the present disclosure and together, with the description, serve to explain the principles of the present disclosure. In the drawings.

DETAILED DESCRIPTION

Figure 1:
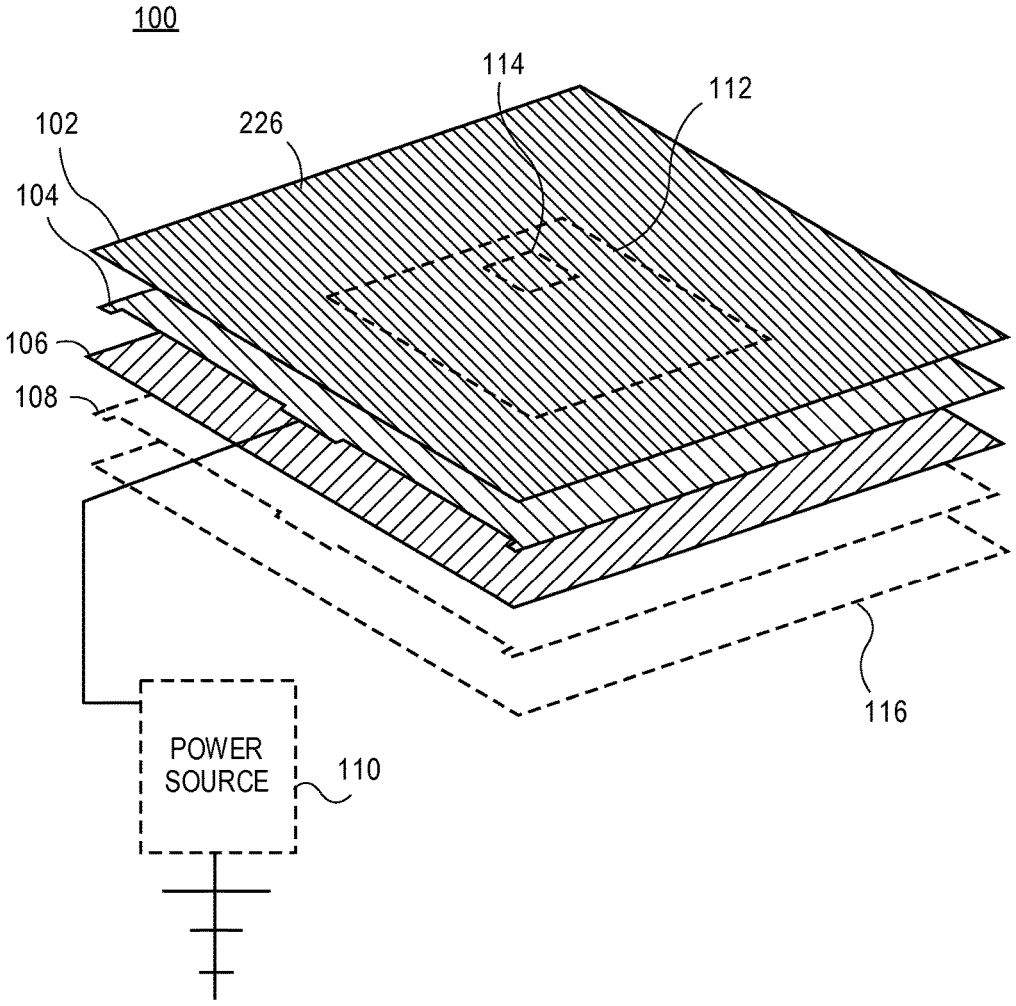
FIG. 1 is a diagram depicting an exploded perspective view of a platen, consistent with some embodiments of the present disclosure.

The following detailed description refers to the accompanying drawings. Wherever convenient, the same reference numbers are used in the drawings and the following description to refer to the same or similar parts. While several exemplary embodiments and features of the present disclosure are described herein, modifications, adaptations, and other implementations are possible, without departing from the spirit and scope of the present disclosure. Accordingly, the following detailed description does not limit the present disclosure. Instead, the proper scope of the disclosure is defined by the appended claims.

As noted above, current printing devices may utilize one or more fans in order to generate a vacuum via which a printing material may be positioned and held on a platen. However, the one or more fans used in creating the vacuum are noisy. Further, the image formed on the printing material may include artifacts from the holes machined in the platen. Still further, the solid ink that remains on the platen is difficult to clean due to the numerous holes in the platen. Ink that has not been cleaned from the holes of the platen may diminish the effect of the vacuum resulting in the positioning of the printing material on the platen being unstable, which may affect printing. Still further, thermal gradients may be generated by the air flow through the holes in the platen.

Other past embodiments of electrostatic platen holdowns (eg. pen plotters) used interdigitated electrodes to hold paper down which required some moisture embedded in the paper to provide conductivity. The interdigitated electrodes may induce fields and steer the drops thus creating banding.

In order to address one or more of these shortcomings, an electrostatic platen is provided that includes a continuous conductive layer. The conductive layer of the platen is continuous in that it does not include any machined holes in a printing area where the printing material is to be positioned during a printing process, for example, the printing area is unperforated. A power source is provided and is electrically coupled to the continuous conductive layer in order to generate an electric field. The printing material further includes a conductive layer. The conductive layer of the printing material electronically couples to the electric field generated by the conductive layer of the platen in order to firmly position the printing material on the platen. By coupling the printing material to the platen via an electric field instead of the vacuum method described above, the thermal gradients may be reduced as there is no air flowing through the platen.

The platen may further include a thermal layer. When the thermal layer heats up, any ink materials remaining on the platen after a printing process may be easily removed, thereby improving the quality of the printing process and improving the ease of cleaning the platen. Further, as the conductive layer is a continuous conductive layer, and therefore has no holes provided therein, any waste or accidental ink remaining after a printing process remains on a top surface of the platen and is easily removed when the heater heats up the platen.

FIG. 1 depicts an exploded view of an example electrostatic platen 100 in accordance with some examples disclosed herein. As shown in FIG. 1, platen 100 includes a dielectric layer 102 provided on a first surface of a continuous conductive layer 104. A second dielectric layer 106 is provided on a second surface of the continuous conductive layer 104, the second surface of the continuous conductive layer 104 being opposite to the first surface of the continuous conductive layer 104. The dielectric layers 102 and 106 may be made of an insulating material that are not electrically conductive and are therefore suitable to provide electric separation of the various layers in the platen. For example, the dielectric layers 102 and 106 may be made of Kapton®, a polyamide film that remains stable across a wide range of temperatures, from −269° to 400° C. Other suitable materials may be used with high dielectric strength and a high dielectric constant. In an example discussed below, Table 1 depicts properties of Kapton that make the material suitable for use in the platen 100 as discussed herein. Other suitable materials may have properties that are 50% more or less, and more suitably 25% more or less, than the values depicted in Table 1 and be suitable for use in platen 100.

According to some examples, the continuous conductive layer 104 may be implemented as a continuous layer of a conductive material having an unperforated printing area. The continuous conductive layer 104 is continuous in that there are no holes in the printing area where a printing material may be placed on the continuous layer. The conductive layer 104, in a position outside of the printing area, may include alignment holes that may be used to attach the continuous layer to other layers in the platen 100. The conductive material may be implemented as any material that is suitable to conduct, for example, aluminum with a thickness of 0.4 mm. The thickness of the continuous conductive layer 104 may be more or less than 0.4 mm so long as the continuous conductive layer 104 is suitable, in that it is thermally and electrically conductive, to sustain an electric field that may hold a printing material on the platen with sufficient force for printing. The continuous conductive layer 104 may include a continuous plane of electrodes to which a voltage may be applied.

The platen 100 may further include a power source 110 that is capable of supplying power to the platen 100. By applying power, for example, a voltage, via the power source 110 to the platen 100, an electric field may be generated. The voltage source is or is approximately 1 kv.

According to some embodiments, the platen 100 may optionally include a thermal spreader layer 108 that is thermally and electrically conductive. According to some examples, the thermal spreader layer 108 may be implemented as copper having a thickness of 0.1 mm. The thickness of the thermal spreader layer 108 may be more or less than 0.1 mm so long as the thermal spreader layer is suitable, in that it is thermally and electrically conductive, to sustain an electric field that may hold a printing material on the platen with sufficient force for printing. Thermal spreader layer 108 may include a thermal temperature sensor (not shown), for example, a thermistor that is positioned between two traces 232. According to some examples, the temperature goal for this process is 76 C+−2.5 C.

Platen 100 may be mounted on a support frame 116 to support the platen 100 in a printing device.

A printing material 112 may be placed on the platen 100. The printing material may be implemented as, for example, polyethylene terephthalate (PET) including a conductive coating, or any other printing material with a conductive coating suitable to electrically couple with the electric field generated in the platen 100. The conductive coating may be on a surface of the printing material that is opposite to a surface of the printing material 112 that is adjacent to the platen 100. The electric coupling of the printing material to the platen 100 is suitable to hold the printing material 112 flat against the platen 100 in a position with sufficient force such that a printing operation on the printing material may be made without the printing material shifting during the printing process. The printing material may be implemented as, for example, a PET sheet having a thickness of 125 to 200 um and includes a conductive top layer is held flat onto a platen to allow phase change ink jet imaging onto the conductive side of the film. A grounding device 114, for example, a brush, clip, etc., may make contact between the conductive layer of the printing material 112 and ground. The conductive coat may also be on the side contacting the top dielectric layers 102, and has an electrical path to ground via grounding device 114. Also the printing material 112 could be slightly conductive throughout its thickness such as typical paper with typical moisture content. Again an electrical path to ground is provided.

Figure 2:
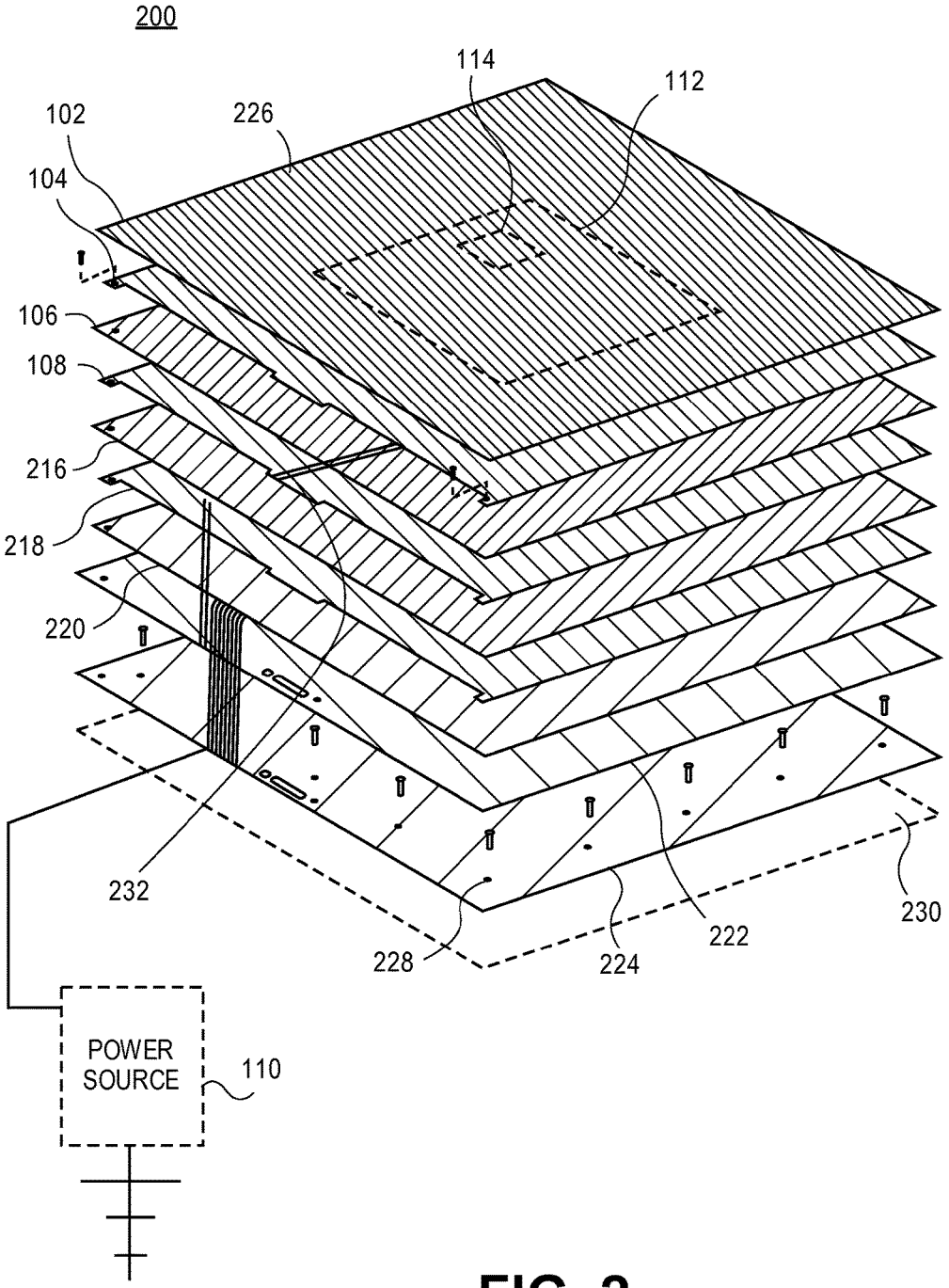
FIG. 2 is a diagram depicting an exploded perspective view of a platen, consistent with some embodiments of the present disclosure.

FIG. 2 depicts an exploded view of electrostatic platen 100 in accordance with some other examples disclosed herein. FIG. 2 depicts a platen 200 including the dielectric layer 102, the continuous conductive layer 104, the second dielectric layer 106, the thermal spreader layer 108, the power source 110, the printing material 112, and the grounding device 114 as discussed above with regard to FIG. 1. According to the example depicted in FIG. 2, platen 200 may further include a dielectric layer 216 on a surface of the thermal spreader layer 108 that is opposite to the surface of the thermal spreader layer 108 on which the dielectric layer 106 is provided.

Platen 200 may further include a thermal layer 218 provided on a surface of the dielectric layer 216 that is opposite to a surface of the dielectric layer 216 on which the thermal spreader layer 108 is provided. The thermal layer 218 may be implemented as a conductive layer, for example, Inconel, the conductive layer having controlled resistivity such that changes in the resistivity of the conductive layer is small as the temperature of the material increases. Thermal layer 218 may include one or more heaters that are electrically connected to power source 110. The one or more heaters may be implemented to produce a total of, for example, 1500 watts or approximately 1500 watts, or have sufficient wattage to enable the heating of the platen 200 resulting in phase change of the solid ink for cleaning purposes. According to some examples, the thermal layer 218 may include one heater, two heaters, three heaters, four heaters, etc. According to some examples the thermal layer 218 may be implemented as four heaters having a total wattage of 1500 watts with four different circuits so that current for each circuit can be kept low, thus reducing flicker.

Platen 200 may further include dielectric layer 220. Dielectric layer 220 may be provided on a surface of thermal layer 218 that is opposite to a surface of the thermal layer 218 on which the dielectric layer 216 is provided on. Dielectric layers 216 and 220 may be implemented with materials and properties similar to the dielectric layers 102 and 106 as discussed with regard to FIG. 1.

Platen 200 may further include support layer 222 and support layer 224. Support layer 222 and support layer 224 may be implemented as, for example, two piece laminate that may be mounted on a sliding stage, or support frame, that traverses under print heads during printing process. Support layer 222 and support layer 224 may be implemented as, for example, fiberglass reinforced epoxy laminate FR4, each having a thickness of or about 2.4 mm. By providing support layer 222 and support layer 224, sufficient rigidity is provided with low thermal conductivity. Alternatively, other materials may be used, with sufficient rigidity and low thermal conductivity to support and enable the platen to transverse under print heads in the printer device.

One or more layers of platen 200 may include registration holes through which registration pins may be inserted to assist in alignment of the layers during the manufacturing process. Further support layer 224 may include one or more holes 228 through which a fastening device, for example, screw, tack, etc., may be used to attach the platen to a support frame 230.

By providing platen 100 or platen 200 as discussed herein, a printing material having a conductive top layer on a polymer base or paper with some moisture content may be reliably tacked and un-tacked onto a platen. Electrostatic forces are used to tack the printing material to the platen. To enable this, the conductive layer of the platen is suitably electrically insulated from nearby grounded parts to allow applying a voltage that may be in, for example, the <2000 volt range. The top platen surface that the printing material is tacked to has a suitably high resistivity coating over the conductive layer to for example avoid operator safety and other issues that might otherwise be a concern when the platen is biased in the tacking method. An electrical connection to the conductive layer of the platen is provided and an external power source is used to apply a voltage to the platen. To create an electrostatic force between the printing material and the platen, a reliable conductive path is provided between the conductive layer on the printing material and ground while a voltage V is applied to the platen. This creates an electrostatic field between the printing material and the platen surface which results in an electrostatic holding force to hold the printing material to the platen surface. To substantially remove the force to allow easy removal of the printing material from the platen, the voltage on the platen is switched to zero and the ground brush touching the conductive top surface removes the charge to prevent operator shock.

In operation, the printing material 112 may be placed onto the platen 100. A smoothing process (eg. using a foam flattening roll) may be performed to smooth the printing material 112 onto the platen 100 as a bias is applied to the platen to generate an electric field thereby applying a tack force to tack the printing material 112 onto the platen 100. High stiffness of the printing material 112 would assist in removal of undesirable wrinkles and bubbles as the sheet tacks to the platen 100. The voltage from the power source 110 may optionally be increased to create a high tack force between the printing material 112 and platen 100 during the imaging process, thereby ensuring no movement of the printing material 112 on the platen 100. After the imaging process, the printing material 112 may be removed from the platen by returning the bias on the platen to ground potential in order to reduce the tack force.

By providing platen 100, printing material 112 may be held flat against the platen 100 and printed on, for example, using a phase change solid ink. As the platen 100 does not include holes around (i.e., within) the printing area, the image printing on the printing material 112 may not include any artifacts that may be created using conventional platens that use a vacuum method to hold the printing material in place. Further, any ink remaining on the platen may be easily cleaned from the continuous surface as there are no holes in which the ink may accumulate and clog the holes.

Figure 3:
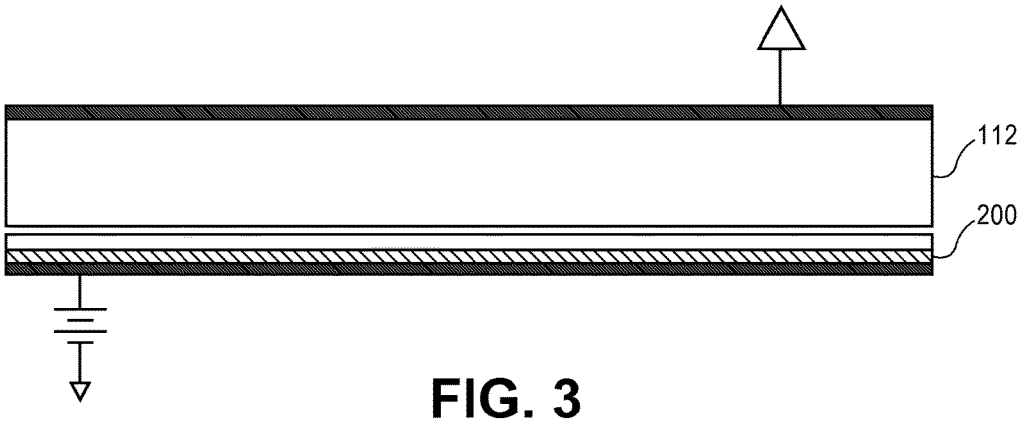
FIG. 3 is a diagram depicting a side view of a platen and a printing material on the platen, consistent with some embodiments of the present disclosure.

FIG. 3 depicts a side view of an example platen 200 having positioned thereon a printing material 112. The strength of the electrostatic force, or tack force, is dependent on the voltage applied and the sum of the individual dielectric thicknesses of the dielectric layers between the conductive layer on the printing material 112 and the continuous conductive layer 104 of platen 100. The sum of the dielectric thicknesses will be referred to here as the "total dielectric thickness", $D_T$. "Dielectric thickness" term used here is the actual thickness of an insulating layer divided by the low frequency (typically 100 hz) dielectric constant of the insulator. The tack pressure P on the sheet is given by: $P=\in_0 [V/D_T]^2/2$, where $\in_0$ is a constant equal to $8.85\times10^{-12}$ farads/M in MKS units. The total dielectric thickness is of the sum of the dielectric thickness of the dielectric layer on the platen, a small air film between the platen and the PET film (typically <10 microns), and the PET film dielectric thickness.

The following represents an example implementation of the platen as discussed herein. Table 1 depicts example values of the configuration of the various layers as discussed with regard to FIG. 1.

TABLE 1

| | variable | units | value |
|---|---|---|---|
| Thickness Kapton | | um | 50 |
| Dielectric constant Kapton | | | 3.5 |
| Dielectric thickness Kapton | | um | 14.3 |
| dielectric strength | | kv/mm | 217 |
| dielectric breakdown at 50 um | | kv | 10.85 |
| Thickness PET | | um | 125 |
| Dielectric thickness PET | | | 3.6 |
| Dielectric thickness PET | | um | 34.7 |
| dielectric strength | | kv/mm | 200 |
| dielectric breakdown at 50 um | | kv | 25 |
| Thickness air film | | um | 10 |
| Dielectric thickness air film | | | 1 |
| Dielectric thickness total | Dtot | um | 59 |
| Dielectric thickness total | Dtot | cm | 0.0059 |
| Dielectric thickness total | Dtot | m | 5.901E−05 |
| absolute dielectric permittivity | $\epsilon_0$ | F/m = coulomb/Vm | 8.85E−12 |
| vacuum epsilon | | | |
| voltage applied DC | V | v | 1000 |
| sigma | σ | coulomb/m^2 | −0.00015 |
| Electrostatic field V/Dtot | E | volt/um | 16.9 |
| Electrostatic field σ/ε1 check | E | volt/um | −1.69E+01 |
| pressure applied to sheet | P | N/m^2 | 1.27E+03 |
| pressure applied to sheet | P | dynes/cm^2 | 1.27E+04 |
| pressure applied to sheet | P | psi | 1.84E−01 |
| pressure applied to sheet check | P | psi | 1.84E−01 |
| Area of sheet | A | inch^2 | 624 |
| Area of sheet | A | m^2 | 0.403 |
| Total hold down force | Ftot | N | 5.12E+02 |
| coef friction (PET to Kapton) | | | 0.25 |
| pull force to check electrostatic pressure | | N | 1.28E+02 |
| pull force to check electrostatic pressure | | lb | 2.87E+01 |

TABLE 1-continued

| thermal delta | C | 50 | | Thermal Growth | |
|---|---|---|---|---|---|
| size | mm | 635 | 685.8 | um | |
| | | x | y | x | y |
| Kapton | e-6/C/u/u | 28 | 28 | 889 | 960.12 |
| Aluminum | e-6/C/u/u | 22.9 | 22.9 | 727.075 | 785.241 |
| Copper | e-6/C/u/u | 16.4 | 16.4 | 520.7 | 562.356 |
| Inconel | e-6/C/u/u | 13 | 13 | 412.75 | 445.77 |
| Fiberglass FR4 | e-6/C/u/u | 14 | 12 | 444.5 | 480.06 |

Figure 4:
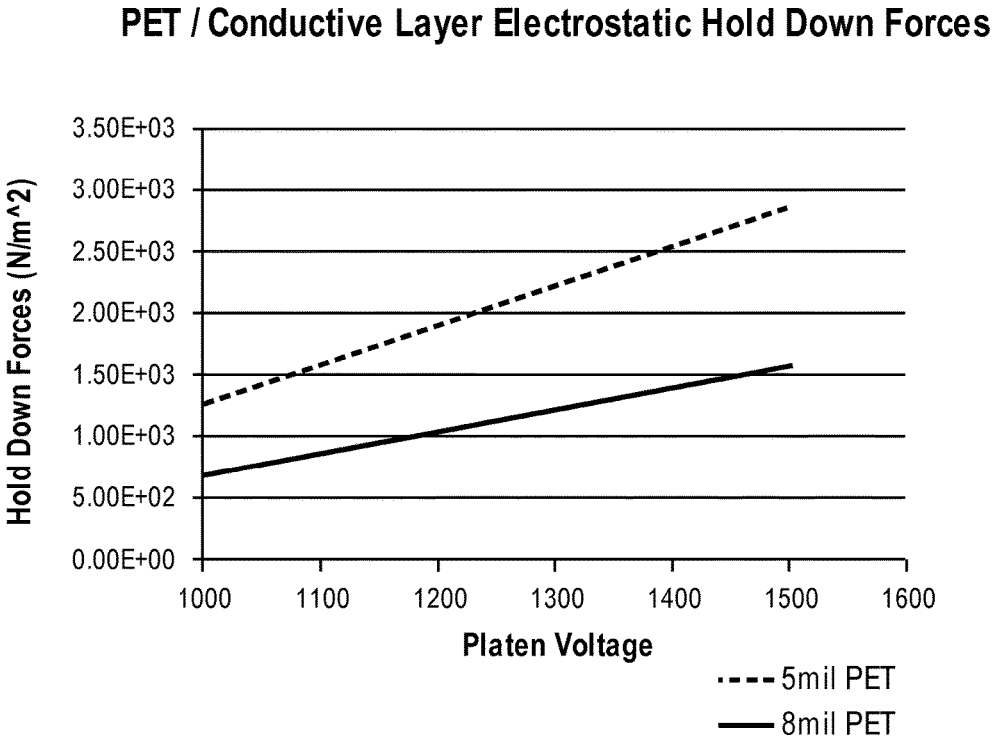
FIG. 4 is a graph depicting hold down forces of a printing material on a platen, consistent with some embodiments of the present disclosure.

FIG. 4 depicts an example of the electrostatic hold down forces, or the tack forces of the platen as disclosed herein when a 5 mil PET printing material and an 8 mil printing material is used. Thus, the tack forces using the platen as discussed herein provide more tack force to hold the printing material on the platen. As can be further appreciated, by providing for a platen as discussed herein the electrostatic field is nulled on the top conductive layer of the printing material to ensure that there is no residual field to steer the drops as they are fired from the jets. Thus, the platen described herein provides for elimination of vacuum holes that could be blocked by leaking heads of mis-firing of jets, elimination of the fan vibration and noise causing MQ defects at 87 hz, easy cleaning of the top layer of Kapton in case of leaky heads or mis-firing of jets, neutralizing the field residuals causing jet steering errors, according to some examples, integrated heater elements with the electrostatic blanket to simplify parts and assembly, one or more thermal spreader layers to make the thermal gradient more uniform for good melt reflow of the solid ink in the image area, and operator safety for removing the charge in the blanket at the end of printing.

The foregoing description of the invention, along with its associated embodiments, has been presented for purposes of illustration only. It is not exhaustive and does not limit the invention to the precise form disclosed. Those skilled in the art will appreciate from the foregoing description that modifications and variations are possible in light of the above teachings or may be acquired from practicing the invention. The steps described need not be performed in the same sequence discussed or with the same degree of separation. Likewise various steps may be omitted, repeated, or combined, as necessary, to achieve the same or similar objectives or enhancements. Accordingly, the invention is not limited to the above-described embodiments, but instead is defined by the appended claims in light of their full scope of equivalents.

What is claimed is:

1. An electrostatic platen device for an ink printing device, the electrostatic platen device comprising:

a printing area over which a printing material is positioned during an ink printing process;

a position outside the printing area;

a continuous conductive layer having an unperforated printing area, wherein the continuous conductive layer comprises a continuous conductive material that is free from holes therethrough within an entirety of the printing area and is uninterrupted in extent within the entirety of the printing area;

a first dielectric layer provided on a first surface of the continuous conductive layer;

a second dielectric layer provided on a second surface of the continuous conductive layer opposite to the first surface of the conductive layer; and a power source electrically coupled to the continuous conductive layer to generate an electric field.

2. The electrostatic platen device of claim 1, further comprising:

a thermal spreader layer provided on a first surface of the second dielectric layer that is opposite to a second surface of the second dielectric layer on which the continuous conductor layer is provided;

a third dielectric layer provided on a first surface of the thermal spreader layer that is opposite to a second surface of the thermal spreader layer on which the second dielectric layer is provided;

a thermal layer provided on a first surface of the third dielectric layer that is opposite to a second surface of the third dielectric layer on which the thermal spreader layer is provided; and a fourth dielectric layer provided on a first surface of the thermal layer that is opposite to a second surface of the thermal layer on which the third dielectric layer is provided.

3. The electrostatic platen device of claim 2, further comprising:

a thermal temperature sensor provided on the thermal spreader layer.

4. The electrostatic platen device of claim 2, further comprising:

heating circuitry provided on the thermal layer.

5. The electrostatic platen device of claim 2, further comprising:

an insulation layer provided on a first surface of the fourth dielectric layer that is opposite to a second surface of the second dielectric layer on which the thermal layer is provided.

6. The electrostatic platen device of claim 1, further comprising:

an insulation layer provided on a first surface of the second dielectric layer that is opposite to a second surface of the second dielectric layer on which the continuous conductive layer is provided.

7. The electrostatic platen device of claim 1, wherein the continuous conductive layer is made substantially of aluminum.

8. The electrostatic platen device of claim 1, wherein the dielectric layers are made substantially of Kapton.

9. The electrostatic platen device of claim 2, wherein the thermal spreader layer is made substantially of copper.

10. The electrostatic platen device of claim 1, further comprising:

a support frame having provided thereon the second dielectric layer.

11. An electrostatic platen device for an ink printing device, the electrostatic platen device comprising:

a printing area over which a printing material is positioned during an ink printing process;

a position outside the printing area;

a continuous conductive layer having an unperforated printing area, wherein the continuous conductive layer comprises a continuous conductive material that is free from holes therethrough within an entirety of the printing area and is uninterrupted in extent within the entirety of the printing area;

a first dielectric layer provided on a first surface of the continuous conductive layer;

a second dielectric layer provided on a second surface of the continuous conductive layer opposite to the first surface of the conductive layer;

a thermal spreader layer provided on a first surface of the second dielectric layer that is opposite to a second surface of the second dielectric layer on which the continuous conductor layer is provided;

a third dielectric layer provided on a first surface of the thermal spreader layer that is opposite to a second surface of the thermal spreader layer on which the second dielectric layer is provided;

a thermal layer provided on a first surface of the third dielectric layer that is opposite to a second surface of the third dielectric layer on which the thermal spreader layer is provided; and a fourth dielectric layer provided on a first surface of the thermal layer that is opposite to a second surface of the thermal layer on which the third dielectric layer is provided.

12. The electrostatic platen device of claim 11, further comprising:

a thermal temperature sensor provided on the thermal spreader layer.

13. The electrostatic platen device of claim 11, further comprising:

heating circuitry provided on the thermal layer.

14. The electrostatic platen device of claim 13, wherein the heating circuitry includes a plurality of heaters.

15. The electrostatic platen device of claim 11, further comprising:

a thermal insulation layer provided on a first surface of the fourth dielectric layer that is opposite to a second surface of the forth dielectric layer on which the thermal layer is provided.

16. The electrostatic platen device of claim 15, wherein the thermal insulation layer is made substantially of fiberglass.

17. The electrostatic platen device of claim 11, wherein the continuous conductive layer is made substantially of aluminum.

18. The electrostatic platen device of claim 11, wherein the dielectric layers are made substantially of Kapton.

19. The electrostatic platen device of claim 11, wherein the thermal spreader layer is made substantially of copper.

20. The electrostatic platen device of claim 11, further comprising:

a support frame having provided thereon the fourth dielectric layer.

* * * * *